United States Patent [19]

Marik

[11] 4,278,839

[45] Jul. 14, 1981

[54] TANGENT FUNCTION GENERATOR FOR AM STEREO

[75] Inventor: Charles J. Marik, Chicago, Ill.

[73] Assignee: Motorola, Inc., Schaumburg, Ill.

[21] Appl. No.: 63,273

[22] Filed: Aug. 2, 1979

[51] Int. Cl.[3] ..... H04H 5/00; G06G 7/22

[52] U.S. Cl. ..... 179/1 GS; 328/142

[58] Field of Search ..... 179/1 GS; 328/142, 143, 328/21

[56] References Cited

U.S. PATENT DOCUMENTS

| | | | |
|---|---|---|---|
| 3,708,693 | 1/1973 | Ferrier et al. | 328/142 |
| 4,015,079 | 3/1977 | Satou et al. | 328/142 |
| 4,030,039 | 6/1977 | Fahlgren | 328/142 |
| 4,032,797 | 6/1977 | Metcalf et al. | 328/142 |
| 4,172,966 | 10/1979 | Parker et al. | 179/1 GS |

*Primary Examiner*—Douglas W. Olms

*Attorney, Agent, or Firm*—Margaret Marsh Parker; James W. Gillman

[57] ABSTRACT

A function generator as for use in a system of compatible quadrature AM stereo approximates the tangent function curve, allowing for the provision of essentially undistorted intelligence signals. A form of differential amplifier, including additional multiple threshold transistor circuits with common collectors and common bases, has at its input terminals a signal related to an angle of modulation and provides an output signal approaching a signal related to the tangent of the angle of modulation, the accuracy of the approximation depending on the number of circuits included. The function generator has the capability of providing other similar functions and of use in other applications. As used for AM stereo decoding, a tangent function output is derived from the phase modulation components of the stereo signal and, when multiplied by the amplitude modulated signal, the stereo difference signal can be derived.

7 Claims, 4 Drawing Figures

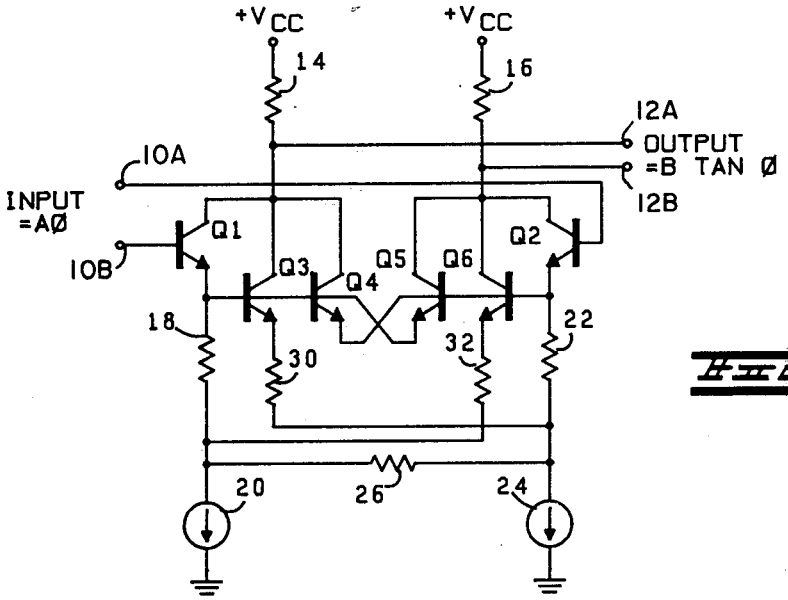
FIG. 1
FIG. 2
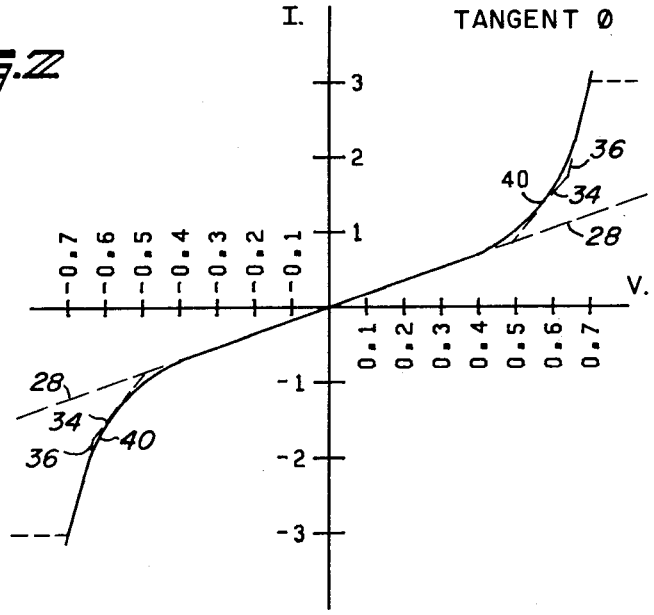

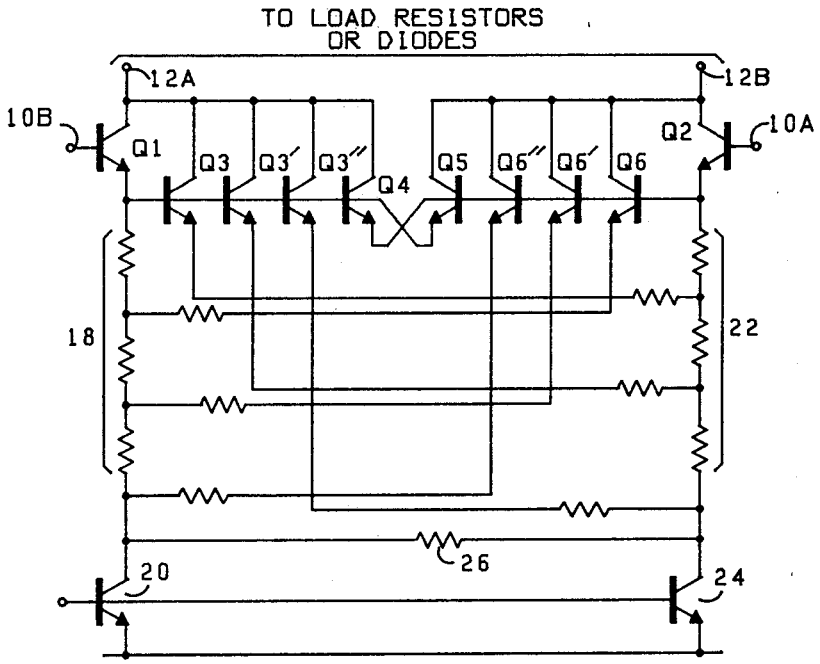
FIG. 3
FIG. 4
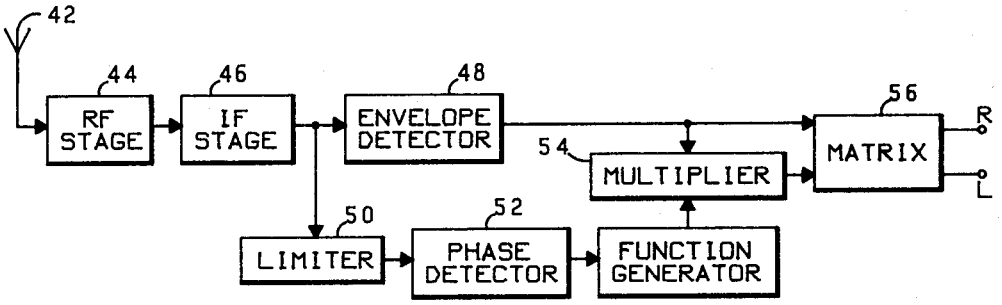
(FIG. 3)

TANGENT FUNCTION GENERATOR FOR AM STEREO

BACKGROUND OF THE INVENTION

This invention relates to the field of function generators, and particularly to a tangent function generator as for use in decoding AM stereo signals. Various forms of non-linear amplifiers are known which can approximate to some degree the curve of a desired function, but in general require very complex circuits in order to achieve a high degree of accuracy.

SUMMARY OF THE INVENTION

It is therefore an object of the present invention to provide a function generator which is simple to construct, as on an integrated circuit chip, and which can provide any desired degree of accuracy.

It is a particular object to provide a tangent function generator as for use in AM stereo decoding.

These objects and others are provided in a circuit in accordance with the present invention and including a form of differential amplifier. The differential amplifier includes a plurality of additional amplifier circuit pairs, each pair having a different threshold, the combined output providing the desired characteristic curve. The basic differential amplifier includes two transistors coupled by resistors to separate current sources, and the resistor/current source junctions interlinked by a resistor. A second pair of alternately conducting transistors is coupled to the first pair and biased to begin conducting only at a first predetermined input signal level. A third pair of alternately conducting transistors is coupled to the first and second pairs of transistors and biased to begin conducting at a second predetermined input signal level, the second level being higher than the first level. Other pairs of transistors may be included to provide higher degrees of smoothing for the output curve.

BRIEF DESCRIPTION OF THE DRAWING

FIG. 1 is a schematic diagram of the basic circuit of the invention.

FIG. 2 is a chart of the curve of the tangent function characteristic.

FIG. 3 is a schematic diagram illustrating the method of expanding the basic circuit.

FIG. 4 is a block diagram of an AM stereo receiver which might utilize the invention.

DETAILED DESCRIPTION OF A PREFERRED EMBODIMENT

FIG. 1 shows the basic circuit diagram for producing a six-segment approximation to an odd order function; i.e., a curve having positive values in the first quadrant and negative values in the third quadrant, such as a tangent curve (see FIG. 2). Applied to the input terminals 10A and 10B is a signal $A\phi$, where A is a constant. The output signal at terminals 12A and 12B is B tan $\phi$, where B is a constant and may equal A. The input signals are applied to the bases of Q1 and Q2, which comprise a form of differential amplifier. The collector of Q1 is coupled to Vcc through a resistor 14 and the collector of Q2 is coupled through a resistor 16. The emitter of Q1 is coupled through a resistor 18 to a current source 20. The emitter of Q2 is coupled through a resistor 22 to a current source 24. The two resistor/current source junctions are linked by a resistor 26.

If only the differential amplifier (Q1, Q2) were in the circuit, the curve of the output voltage would, of course, be a straight line, as shown by line 28 (FIG. 2). This is actually the case at very low input signal levels, and the gain of the amplifier is then determined by the sum of the resistors 18, 22 and 26. The voltage drop across each of the resistors 18 and 22 is designed to be less than one base-emitter drop, and the voltage across the terminals 10A, 10B cannot exceed one base-emitter drop without causing some degree of distortion in the output at terminals 12A, 12B, as will be seen hereinafter.

With the addition of additional amplifiers, biased to the proper thresholds, the summed outputs can approach any desired function curve. As may be seen, the collectors of Q3 and Q4 are tied to the collector of Q1, and the collectors of Q5 and Q6 are tied to the collector of Q2. The bases of Q3 and Q4 are coupled to the emitter of Q1 and the bases of Q5 and Q6 are coupled to the emitter of Q2. The emitters of Q3 and Q4 are coupled to different points on the resistor 22, and the emitters of Q5 and Q6 are coupled to different points on the resistor 18. When the voltage across the two resistors 18 and 26 equals one base-emitter drop, Q3 will begin to conduct (assuming that the voltage on terminal 10B is positive relative to that on terminal 10A), with the current determined by resistor 30. Likewise, on the other half of the input cycle, Q6 will begin to conduct when the voltage across the two resistors 22 and 26 equals one base-emitter drop with the current determined by the resistor 32. These outputs, when added to those of the differential amplifier transistors Q1 and Q2, produces the second segment 34 of the curve of FIG. 2.

As the input signal increases to approximately 0.7 v, the transistor Q4 will begin to conduct during the positive swing, supplying the third portion 36 of the first quadrant half of the curve. During the negative swing of the input signal, Q5 will begin to conduct. It will be seen that the six flat segments of 28, 34, 36 approximate the tangent curve 40. The inherent characteristics of the transistors will, of course, provide a smoothing effect (not shown) to more closely approximate the tangent curve.

The total current of the two groups of collectors can be intentionally limited (as shown by the dashed line at 3 amperes) as for instance by allowing current sources 20, 24, to reach a saturation current level at the desired value. Such current limiting would be of value in the receiver application of FIG. 4, by preventing the generation of tangent signals greater than the maximum tangent function allowed by the signal.

As seen in FIG. 3, more additional transistor circuits may be added, with bases coupled to the bases of Q3 and Q6 respectively, and collectors of Q1 and Q2 respectively. Each complementary pair is biased to begin conducting at a different input voltage, thus smoothing the output curve to any desired degree. These additional transistors are indicated as Q3′, Q3″, Q6′, Q6″ and may consist of additional emitters in Q3 and Q6, together with the appropriate biasing circuits. The emitters are coupled to taps on the resistors 18 and 22 as shown.

The circuit is particularly well suited to integrated circuit implementation, since the resistors are of low values, and transistors with a minimum of interconnections allow a large number to be used economically; i.e., a relatively small area of the chip is required.

The circuit of FIG. 3 (with forward-biased diodes connected to terminals 12A, 12B) may be used in direct association with a differential amplifier and current matrix to provide Left and Right signals at the output terminals of the multiplier. The multiplier may consist of a differential amplifier coupled directly to the terminals 12A and 12B of FIG. 3. The current source for the differential amplifier would be varied in accordance with the envelope of the transmitted signal (which is defined as $1+L+R$). This modulated current source, together with the differential amplifier, forms a multiplier circuit which would provide a current in the collectors of the differential amplifier which is proportional to $L-R$ on one phase of the differential amplifier output and to $-(L-R)$ on the opposite phase output. By providing two additional current sources proportional to $1+L+R$ and adding the current from those sources directly to the load circuits in the output of the differential amplifier, one obtains through the addition of currents in the load circuits signal voltages proportional to L and R.

FIG. 4 is a block diagram of a receiver such as might be used in the system of AM stereo (compatible quadrature) as disclosed in a co-pending patent application, Ser. No. 880,686, and assigned to the same assignee as is the present invention. In the referenced application it is shown that a quadrature broadcast signal of the form $(1+L+R)\cos(\cos\omega_C t+\phi)$ can be decoded without providing a signal proportional to $\cos\phi$ and without division by that signal. (L and R represent two program signals, such as left and right stereo signals, $\omega_C t$ is the carrier frequency, and $\phi$ represents the stereo information.) A circuit for a non-linear amplifier was provided in FIG. 3A of that receiver, but the circuit of the present invention can be made to provide any desired degree of correspondence to the tangent curve, depending on the number of additional amplifier circuits included, with a greater degree of control.

To briefly summarize the operation of the receiver of FIG. 4, an input portion comprising an antenna 42, RF stage 44 and IF stage 46 will supply a signal related to the broadcast signal as given above. In an envelope detector 48, the sum signal $1+L+R$ is obtained. In a limiter circuit 50 the amplitude variation is removed from the input portion output signal, leaving only the phase information. The limiter output signal, which is proportional to $\cos(\omega_C t+\phi)$, is coupled to a phase detector 52, which may consist of a discriminator/integrator combination. The output signal from the phase detector circuit is proportional to $\phi=\text{arc tan}(L-R)/(1+L+R)$. This signal is coupled to the function generator of FIG. 3 which, for this application, is designed to provide a tangent function curve. In this case, the output signal of the function generator will be proportional to $\tan\phi=[(L-R)/(1+L+R)]$. When this signal is coupled to a multiplier 54 and therein multiplied by the output signal of the envelope detector 48, the result will be s signal proportional to $L-R$. This signal, together with the output signal from the envelope detector 48, is coupled to a matrixing circuit 56 for providing signals representing the original L and R signals. These latter signals would be coupled to some form of audio circuit, for reproduction or recording.

Thus, there has been shown and described a function generator which can provide a highly accurate output signal representing a function such as a tangent curve. Application of the function generator to a particular AM stereo signal has also been shown. It can be seen that the circuit may have many other applications, as well as other variations and modifications, and it is intended to cover all such as fall within the spirit and scope of the appended claims.

What is claimed is:

1. A function generator comprising in combination:

means for providing a two-quadrant input signal;

differential amplifier means coupled to the input means for linearly amplifying the input signal;

a plurality of additional amplifier means coupled to the differential amplifier means, each additional amplifier means comprising a pair of first and second transistors biased to a threshold level different from the threshold level of each other additional amplifier means and only one transistor of each pair conducting during each polarity of the input signal; and means for combining the outputs of all amplifier means.

2. A function generator in accordance with claim 1 wherein the additional amplifier means comprise linear amplifiers.

3. A function generator in accordance with claim 2 wherein the function generated is a two quadrant function.

4. A function generator as in claim 1 wherein the input signal is representative of an angle and the function generated is a tangent of said angle.

5. A two-quadrant tangent function generator as for use in an AM stereo receiver and comprising in combination:

means for providing an input signal proportional to an angle of modulation;

differential amplifier means coupled to the input means for linearly amplifying the input signal;

a plurality of additional linear amplifier means coupled to the differential amplifier means, each additional amplifier means comprising a pair of first and second transistors biased to a threshold level different from the threshold level of each other additional amplifier means and only one transistor of each pair conducting during each polarity of the input signal; and means for combining the outputs of all amplifier means to provide an output proportional to the tangent of the angle of modulation.

6. Stereo decoding circuitry as for use in an AM stereo receiver for receiving a signal of the form $(1+L+R)\cos(\omega_C t+\phi)$ and comprising in combination a tangent $\phi$ function generator including means for providing a two-quadrant input signal proportional to an angle of modulation, first differential amplifier means coupled to the input means for linearly amplifying the input signal, a plurality of additional linear amplifier means coupled to the differential amplifier means, each additional amplifier means comprising a pair of first and second transistors biased to a threshold level different from the threshold level of each other additional amplifier means and only one transistor of each pair conducting during each polarity of the input signal, and diode means for combining the outputs of all amplifier means to provide an output proportional to the tangent of the angle at modulation;

second differential amplifier means coupled to the diode means of the tangent $\phi$ function generator; and first current source coupled to the second differential amplifier and providing a current proportional to 1+L+R, whereby the second differential amplifier provides an output current proportional to (1+L+R) tan $\phi$.

7. Stereo decoding circuitry in accordance with claim 6 and further including second and third current sources, for providing a current proportional to 1+L+R and coupled to the second differential amplifier output terminals for providing output signals proportional to L+R.

* * * * *